US010289044B1

(12) United States Patent
Morino

(10) Patent No.: US 10,289,044 B1
(45) Date of Patent: May 14, 2019

(54) IMAGE FORMING APPARATUS CONFIGURED TO ADJUST IMAGE FORMING PARAMETERS BASED ON LENGTH OF TIME TAKEN TO CHANGE FIXING SECTION TEMPERATURE FROM A CURRENT TEMPERATURE TO A TARGET TEMPERATURE

(71) Applicants: KABUSHIKI KAISHA TOSHIBA, Tokyo (JP); TOSHIBA TEC KABUSHIKI KAISHA, Tokyo (JP)

(72) Inventor: Shigeru Morino, Numazu Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/928,232

(22) Filed: Mar. 22, 2018

(51) Int. Cl.
*G03G 15/20* (2006.01)
*G03G 15/00* (2006.01)

(52) U.S. Cl.
CPC ..... *G03G 15/205* (2013.01); *G03G 15/5016* (2013.01)

(58) Field of Classification Search
CPC ..... G03G 15/205; G03G 15/5016; G03G 15/5041; G03G 15/5058
See application file for complete search history.

(56) References Cited

U.S. PATENT DOCUMENTS 5,394,231 A 2/1995 Sudo et al.
7,689,136 B2 * 3/2010 Nakase ..... G03G 15/50 399/44
2016/0139545 A1 * 5/2016 Katakura ..... G03G 15/2039 399/70

FOREIGN PATENT DOCUMENTS

JP 2002116586 A 4/2002

OTHER PUBLICATIONS

U.S. Appl. No. 15/903,777, filed Feb. 23, 2018.

* cited by examiner

*Primary Examiner* — Hoang X Ngo
(74) *Attorney, Agent, or Firm* — Kim & Stewart LLP

(57) ABSTRACT

An image forming apparatus comprises an image forming section configured to form an image on a sheet, a fixing section configured to heat the sheet having the image formed thereon to a fixing temperature, and a control section. The control section is configured to adjust parameters of the image forming section to reduce deterioration in image quality of the image formed by the image forming section and to carry out the adjustment while a temperature of the fixing section is being changed by greater than a predetermined amount and to not carry out the adjustment while the temperature of the fixing section is changed by less than a predetermined amount.

6 Claims, 9 Drawing Sheets

FIG.3

901

| TONER CATEGORY INFORMATION | FIXING TEMPERATURE | STANDBY TEMPERATURE |
|---|---|---|
| DECOLORABLE TONER | TE-Print | TE-Wait |
| NON-DECOLORABLE TONER | TK-Print | TK-Wait |

991

IMAGE FORMING APPARATUS CONFIGURED TO ADJUST IMAGE FORMING PARAMETERS BASED ON LENGTH OF TIME TAKEN TO CHANGE FIXING SECTION TEMPERATURE FROM A CURRENT TEMPERATURE TO A TARGET TEMPERATURE

FIELD

Embodiments described herein relate generally to an image forming apparatus.

BACKGROUND

On occasion, an image forming apparatus may carry out an image quality maintenance processing to reduce the amount of deterioration in the image quality of a formed image. However, an image forming processing cannot be carried out while the image quality maintenance processing is being executed. Thus, if the image quality maintenance processing is executed when a user wants to carry out image forming processing, the user needs to wait for the completion of the image quality maintenance processing prior to starting the image forming processing.

DESCRIPTION OF THE DRAWINGS

FIG. 3 is a diagram illustrating a specific example of setting information according to the embodiment;

DETAILED DESCRIPTION

In accordance with an embodiment, an image forming apparatus comprises an image forming section configured to form an image on a sheet, a fixing section configured to heat the sheet having the image formed thereon to a fixing temperature, and a control section. The control section is configured to adjust parameters of the image forming section to reduce deterioration in image quality of the image formed by the image forming section and to carry out the adjustment while a temperature of the fixing section is being changed by greater than a predetermined amount and to not carry out the adjustment while the temperature of the fixing section is changed by less than a predetermined amount.

Hereinafter, an image forming apparatus according to an embodiment is described with reference to the accompanying drawings.

Figure 1:
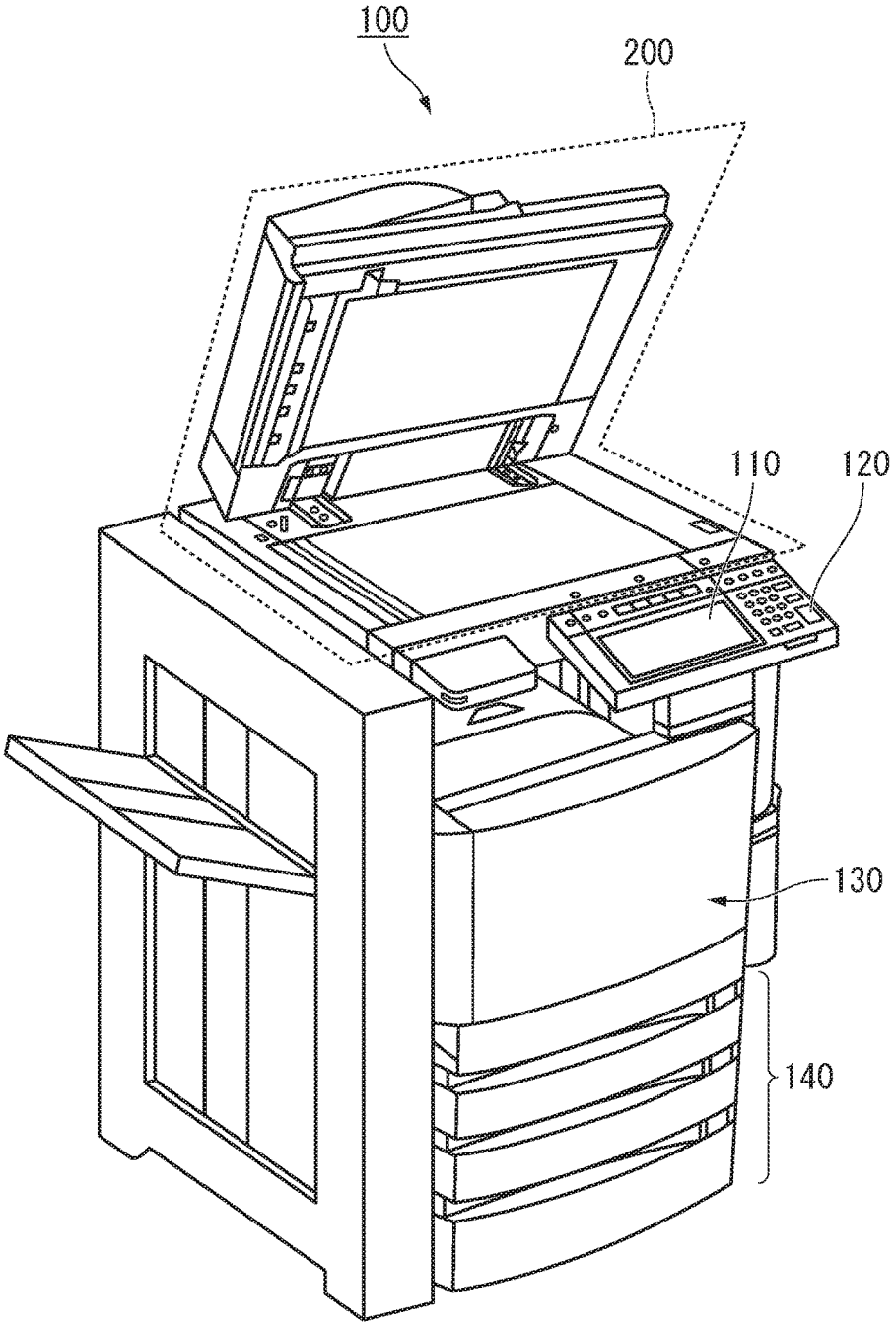
FIG. 1 is a schematic external view illustrating an image forming apparatus according to an embodiment.

FIG. 1 is a schematic external view illustrating a specific example of an image forming apparatus 100 according to the embodiment. The image forming apparatus 100 is, for example, an MFP (Multi-Function Peripheral). The image forming apparatus 100 includes a display 110, a control panel 120, a printer 130, a sheet housing section 140 and an image reading section 200. Furthermore, the printer 130 of the image processing apparatus 100 may be a device for fixing a toner image.

The image forming apparatus 100 forms an image on a sheet with toner. The sheet is, for example, a paper sheet or a label paper sheet. Any type of sheet can be used unless the image forming apparatus 100 can form an image on the surface of the sheet.

The display 110 is an image display device such as a liquid crystal display, an organic EL (Electro Luminescence) display and the like. The display 110 is configured to display various kinds of information relating to the image forming apparatus 100.

The control panel 120 includes a plurality of buttons. The control panel 120 receives an operation input from a user. The control panel 120 outputs a signal corresponding to an operation input by the user to a control section of the image forming apparatus 100. In the example of FIG. 1, the display 110 and the control panel 120 are separately provided. However, both of the display 110 and the control panel 120 may be integrally provided as a touch panel display. For example, the control panel 120 acquires information (hereinafter, referred to as "image formation instruction information") instructing the image forming apparatus 100 to form an image. The image formation instruction information is input to the control panel 120 by a user.

The image formation instruction information includes image information and toner selection information. The image information indicates an image to be formed by the image forming apparatus 100. The toner selection information indicates a selection of toner to be used for the image formation based on the image information.

The printer 130 is an example of an image forming section that forms the image based on the image information on the sheet with the toner indicated by the toner selection information on the basis of the image formation instruction information. The image information may be image information generated by the image reading section 200 or image information received via a communication path.

The sheet housing section 140 houses a sheet subjected to the image formation by the printer 130. Furthermore, a sheet manually fed to the image forming apparatus 100 may be a sheet subjected to the image formation by the printer 130.

The image reading section 200 reads the image information of a read object, such as a sheet or a book type document on which image is formed, as intensity of light. The image reading section 200 records the read image information. The recorded image information may be sent to another information processing apparatus via a network. The recorded image information may be used for the image formation on the sheet by the printer 130.

Figure 2:
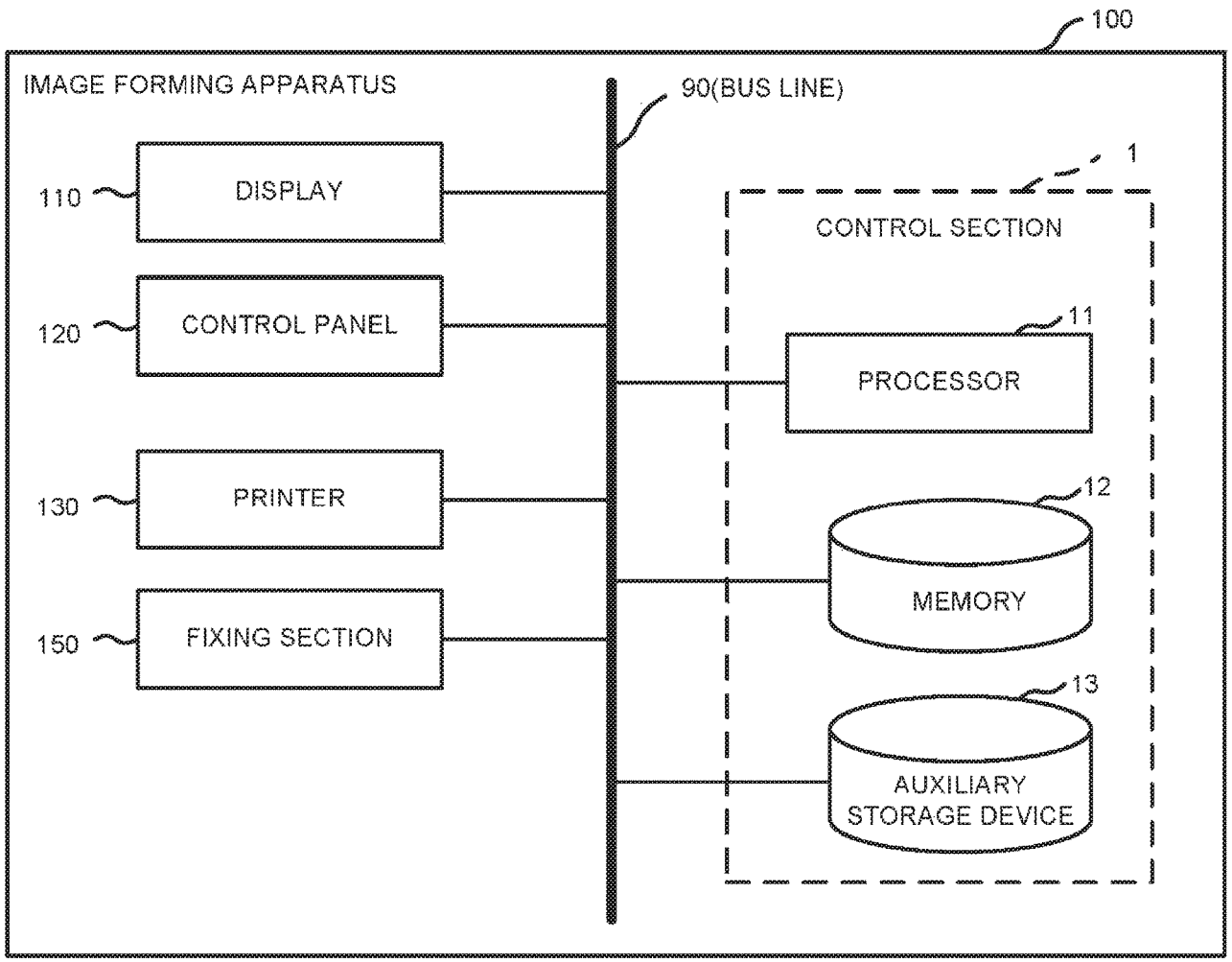
FIG. 2 is a diagram illustrating a specific example of a hardware configuration of the image forming apparatus according to the embodiment.

FIG. 2 is a diagram illustrating a specific example of a hardware configuration of the image forming apparatus 100 according to the embodiment. The image forming apparatus 100 includes a processor 11, a memory 12 and an auxiliary storage device 13 connected by a bus line 90. The processor 11 executes programs stored in the memory 12 and the auxiliary storage device 13 to function as a control section 1 that controls each component of the image forming apparatus 100. Specifically, the control section 1 controls the control panel 120, the display 110, the printer 130 and a fixing section 150. Furthermore, all or part of each function of the image forming apparatus 100 may be realized using hardware such as an ASIC (Application Specific Integrated Circuit), a PLD (Programmable Logic Device), and a FPGA (Field Programmable Gate Array). The program may be recorded on a computer-readable recording medium. The computer-readable recording medium is, for example, a storage device such as a flexible disk, a magneto-optical disk, a portable medium such as a ROM and a CD-ROM, a hard disk built in a computer system. The program may be transmitted via an electric communication line.

The printer 130 has an exposure section, a developing section, a primary transfer section, and a secondary transfer section (not shown). For example, the printer 130 operates as follows. The exposure section of the printer 130 forms an electrostatic latent image on a photoconductive drum on the basis of the image information. The developing section of the printer 130 forms a visible image by enabling toner to adhere to the electrostatic latent image on the photoconductive drum. The primary transfer section of the printer 130 transfers the toner image formed on the photoconductive drum onto an image carrier. The secondary transfer section of the printer 130 transfers the visible image formed on the image carrier onto the sheet.

The fixing section 150 includes a heat source such as a heat lamp (not shown). The fixing section 150 generates heat when the heat source is energized. The fixing section 150 fixes the visible image onto the sheet by applying heat and pressure to the sheet.

The auxiliary storage device 13 stores setting information. The setting information relates to a temperature in a standby state and a temperature at the time of fixation by the fixing section 150 included in the printer 130. The standby state refers to a state in which the fixing section 150 waits for acquisition of a fixation instruction signal. The fixation instruction signal refers to a signal for heating the fixing section to a fixing temperature of toner to be fixed onto the sheet. For example, the fixation instruction signal is generated depending on the input of the image formation instruction information to the image forming apparatus 100. Hereinafter, the temperature in the standby state of the fixing section 150 is referred to as a standby temperature.

The time of fixation refers to time when the fixing section 150 heats the sheet and fixes the toner onto the sheet.

The setting information includes toner category information, fixing temperature information, and standby temperature information. The toner category information indicates the category of the toner usable by the image forming apparatus 100. The fixing temperature information indicates the fixing temperature of each toner usable by the image forming apparatus 100. The fixing temperature is a temperature at which the toner is fixed on the sheet. At the time of fixation, the fixing section 150 needs to be heated to the fixing temperature. Thus, hereinafter, for the sake of description, the temperature of the fixing section 150 at the time of fixation is also referred to as the fixing temperature. The standby temperature information indicates the temperature of the fixing section 150 in the standby state.

FIG. 3 is a diagram illustrating a specific example of the setting information according to the embodiment. The setting information is, for example, stored in the auxiliary storage device 13 as a setting information table 901 shown in FIG. 3. The setting information table 901 has a record for each toner category information. Each record has each value of the toner category information, the fixing temperature and the standby temperature. The toner category information represents the category of the toner to be fixed at the time the image forming apparatus 100 forms the image. Specifically, the toner category information has a value representing either the decolorable toner or the non-decolorable toner. The fixing temperature of the setting information represents the fixing temperature of the toner represented by the corresponding toner category. The standby temperature of the setting information represents the temperature of the surface of a portion, through which the sheet to be heated passes, in the fixing section 150 at the time of waiting for an instruction of printing execution from the user in a case in which the printing is executed with the toner represented by the corresponding toner category information. Here, in a case where the fixing section 150 applies heat to a sheet by a heat roller, the surface of a portion in the fixing section 150 is, for example, an outer peripheral surface of the heating roller. Furthermore, the instruction of printing execution is such that, for example, the image formation instruction information is input to the control panel 120.

For example, a record 991 represents that the temperature of the fixing section 150 when the decolorable toner is fixed on the sheet is TE-Print.

Further, the record 991 represents that the temperature of the fixing section 150 in the standby state at the time of waiting for the instruction of printing execution with the decolorable toner is TE-Wait.

Figure 4:
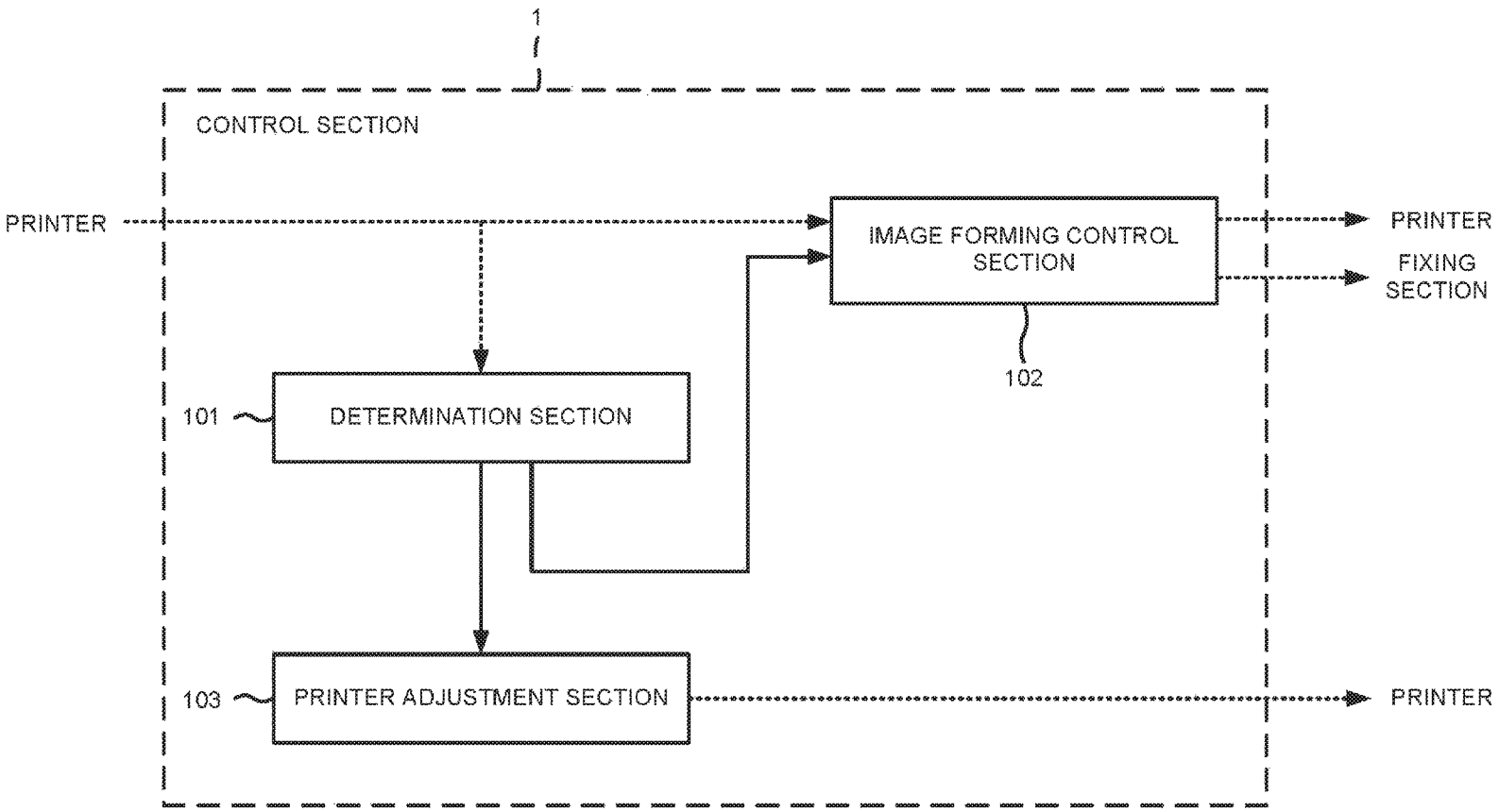
FIG. 4 is a diagram illustrating a specific example of functional components of a control section of the image forming apparatus according to the embodiment.

FIG. 4 is a diagram illustrating a specific example of functional components of the control section 1 of the image forming apparatus 100 according to the embodiment. The control section 1 includes a determination section 101, an image forming control section 102, and a printer adjustment section 103.

The determination section 101 determines whether or not the printer adjustment section 103 needs to be carried out the adjustment processing during change of the temperature of the fixing section 150 on the basis of the image formation instruction information input through the control panel 120. The determination section 101 further determines whether or not the adjustment processing is carried out on the basis of a change amount of the temperature of the fixing section 150 based on the image formation instruction information. Hereinafter, a period during which the temperature of the fixing section 150 is changed is referred to as a temperature change period. The temperature change period is a period during which the fixing section 150 switches from a state (hereinafter, referred to as a "sheet heating state") in which the heat is applied to the toner to fix the toner onto the sheet to a standby state or a period during which the fixing section 150 switches from the standby state to the sheet heating state. Specifically, the determination section 101 determines that the adjustment processing is executable in a case in which the temperature change period is longer than time required for the execution of the adjustment processing (which is a fixed value determined at the time of manufacturing). Further, hereinafter, the state of the fixing section 150 during the temperature change period is referred to as a temperature change state.

The adjustment processing is a processing to reduce deterioration in image quality of an image formed by the image forming apparatus 100. The deterioration in image quality is caused by aging of each functional section of the image forming apparatus 100 and environmental influences such as humidity. Specifically, the adjustment processing is a processing in which the printer adjustment section 103 adjusts an operation of each functional section included in the printer 130. The adjustment processing is executed when the transfer of the toner to the sheet by the image forming apparatus 100 is not carried out.

For example, the adjustment processing is a processing for carrying out an adjustment of an operation of each functional section included in the printer 130 in order to reduce deterioration in the image quality caused by aging and environmental change. For example, in the adjustment processing, the printer adjustment section 103 enables the printer 130 to adjust an adhesion amount of the toner onto the sheet by the following method. For example, the printer adjustment section 103 enables the printer 130 to periodically form a test pattern with the toner on a photoconductor or an intermediate transfer belt and to read this test pattern by an optical sensor. The optical sensor outputs a signal indicating the density of the color of the read test pattern. The printer adjustment section 103 enables the printer 130 to adjust the adhesion amount of the toner to the sheet by adjusting a voltage of a developing bias, a grid bias of a charger and the like on the basis of the density indicated by the output signal described above. Further, for example, the printer adjustment section 103 adjusts the laser power intensity for exposure and the supply amount of toner by the developing device such that the adhesion amount of the toner to the sheet is an appropriate value or amount. In this way, the adjustment processing is a processing in which the printer adjustment section 103 carries out the adjustment of the operation of each functional section included in the printer 130 such that the adhesion amount of the toner to the sheet is an appropriate value or amount. Furthermore, each functional section refers to, for example, a laser light source and the charger.

The determination section 101 enables the printer adjustment section 103 to execute the adjustment processing on the basis of a determination result.

The image forming control section 102 controls each functional section relating to an image forming processing of the image forming apparatus 100 on the basis of the image formation instruction information input through the control panel 120. The image forming apparatus 100 forms an image instructed by the image formation instruction information on the sheet. The image forming control section 102 generates the fixation instruction signal and outputs it to the fixing section 150 if acquiring the image formation instruction information.

When the image forming apparatus 100 finishes the image forming based on the image formation instruction information, the image forming control section 102 stores, in the memory 12 or the auxiliary storage device 13, a value (hereinafter, referred to as a "temperature current value") indicating the temperature of the fixing section 150 at that time, in the auxiliary storage device 13. Each time the image forming apparatus 100 finishes the image forming, the temperature current value is updated by the value representing the temperature of the fixing section 150 at that time.

Furthermore, the time when the image forming apparatus 100 finishes the image forming based on the image formation instruction information is the time when the fixing section 150 fixes the toner onto the sheet and enters the standby state.

The printer adjustment section 103 carries out the adjustment processing according to the control of the control section 1. Through the execution of the adjustment processing, the printer adjustment section 103 carries out the adjustment of the operation of each functional section included in the printer 130. The printer adjustment section 103 carries out the adjustment processing during the temperature change period.

Figure 5A:
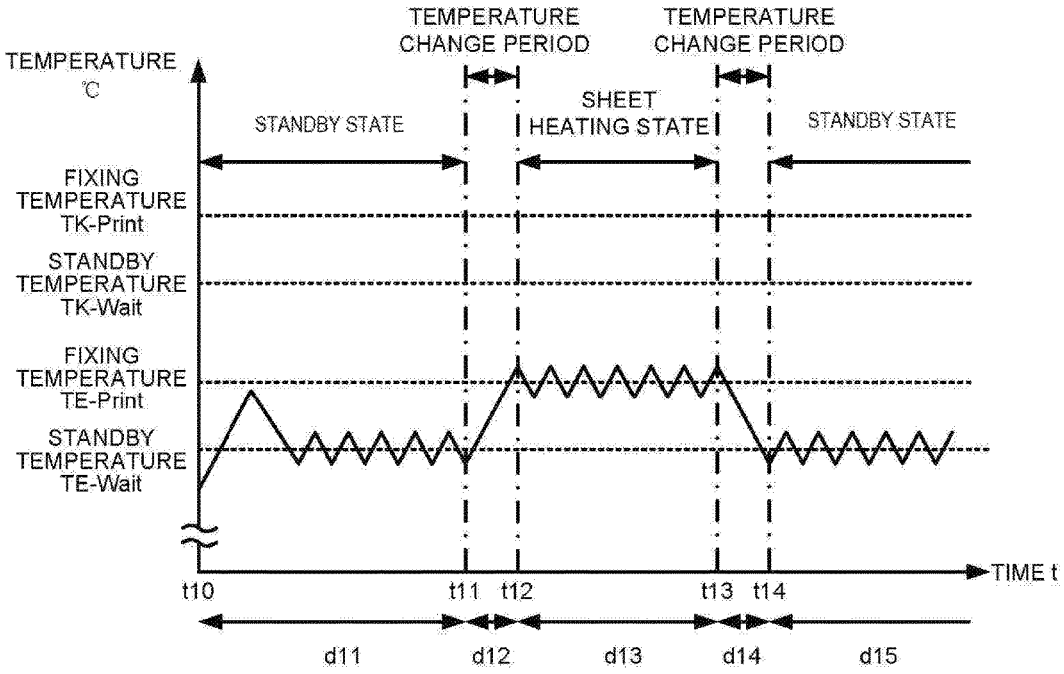
FIG. 5A is a diagram illustrating a specific example of temperature change of a fixing section in a case in which a printer adjustment section does not execute an adjustment processing during a temperature change period.
Figure 5B:
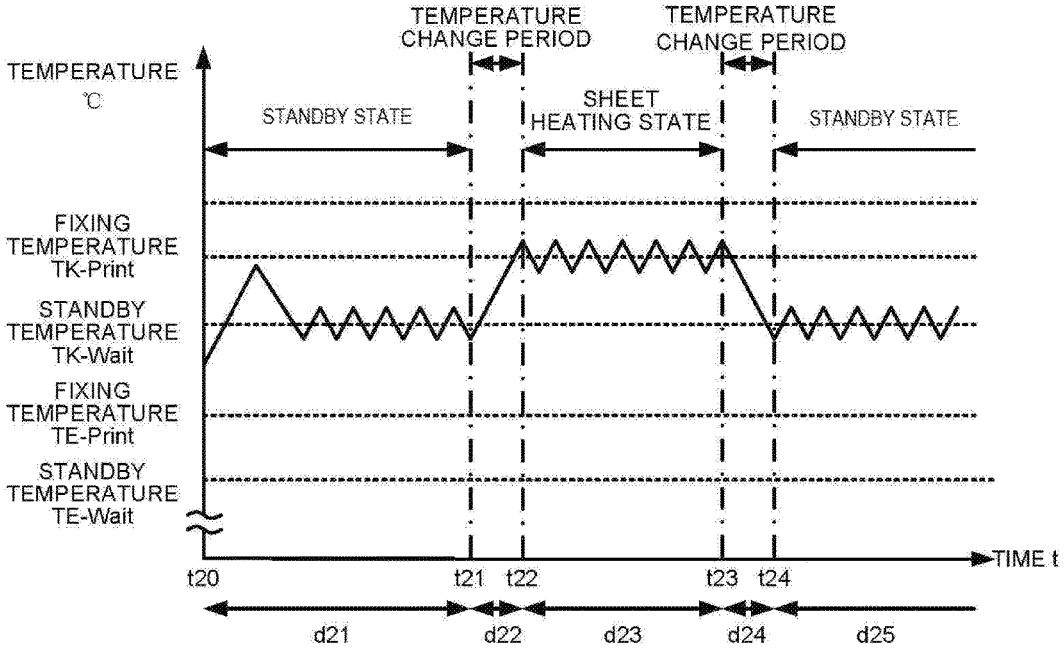
FIG. 5B is a diagram illustrating a specific example of temperature change of the fixing section in a case in which the fixing section fixes the non-decolorable toner onto the sheet.

FIGS. 5A and 5B are diagrams illustrating a specific example of temperature change of the fixing section 150 in a case in which the printer adjustment section 103 does not execute the adjustment processing during the temperature change period.

TE-Print, TE-Wait, TK-Print and TK-Wait in FIGS. 5A and 5B are the same as these in FIG. 3.

In FIGS. 5A and 5B, the following case is assumed and described.

In FIGS. 5A and 5B, the TK-Print is a temperature higher than the TK-Wait, and the TK-Wait is a temperature higher than the TE-Print. Further, the TE-Print is a temperature higher than the TE-Wait.

Further, in FIGS. 5A and 5B, a temperature difference between the TE-Print and the TE-Wait and a temperature difference between the TK-Print and the TK-Wait are smaller than a temperature difference between the TE-Print and the TK-Wait.

Further, the time necessary for the temperature of the fixing section 150 to lower from the temperature TE-Print to the temperature TE-Wait or to rise from the temperature TE-Wait to the temperature TE-Print is shorter than the time required for carrying out the adjustment processing.

The time necessary for the temperature of the fixing section 150 to lower from the temperature TK-Print to the temperature TK-Wait or to rise from the temperature TK-Wait to the temperature TK-Print is shorter than the time required for carrying out the adjustment processing.

The time necessary for the temperature of the fixing section 150 to rise from the temperature TE-Print to the temperature TK-Wait or to lower from the temperature TK-Wait to the temperature TE-Print is longer than the time required for carrying out the adjustment processing.

Furthermore, the image forming apparatus 100 according to the embodiment applies heat having constant heat output per unit time to the fixing section 150 regardless of the category of the toner at the time of the increase of the temperature of the fixing section 150.

FIG. 5A is a diagram illustrating a specific example of the temperature change of the fixing section 150 in a case in which the fixing section 150 fixes the decolorable toner onto the sheet. The decolorable toner is toner of which the temperature at which the toner is fixed on the sheet is the TE-Print.

The vertical axis in FIG. 5A represents the temperature of the fixing section 150. The horizontal axis in FIG. 5A represents the time. The time advances in the sequence of t11, t12, t13, and t14 with t10 as the origin. A period between t10 and t11 is referred to as period d11. A period between t11 and t12 is referred to as period d12. A period between t12 and t13 is referred to as period d13. A period between t13 and t14 is referred to as period d14. A period after t14 is referred to as period d15.

The fixing section 150 is in the standby state during the period d11. The image forming control section 102 controls the fixing section 150 to maintain the temperature to the TE-Wait during the period d11. The fixing section 150 starts to raise the temperature at t11 (hereinafter, referred to as "start of temperature rise"), and after the period d12, the temperature of the fixing section 150 becomes the temperature of the TE-Print at t12. The fixing section 150 fixes the decolorable toner onto the sheet by heating the decolorable toner at the temperature of the TE-Print during the period d13. The fixing section 150 starts to lower the temperature at t13 when the heating of the decolorable toner is finished (hereinafter, referred to as "start of temperature lowering"), and after the period d14, the temperature of the fixing section 150 becomes the temperature of the TE-Wait at t14. The temperature of the TE-Wait is the standby temperature of the fixing section 150 after the decolorable toner is fixed as shown in FIG. 3. The fixing section 150 is in the standby state during the period d15. The image forming control section 102 controls the fixing section 150 to maintain the temperature to the TE-Wait during the period d15. Furthermore, the start of temperature rise refers to the start of a processing for increasing a current flowing through the heat source of the fixing section 150 to raise the temperature of the fixing section 150. Further, the start of temperature lowering refers to the start of a processing for decreasing the current flowing through the heat source of the fixing section 150 to lower the temperature of the fixing section 150. In FIG. 5A, the period d12 is a period during which the temperature of the fixing section 150 rises from the TE-Wait to the TE-Print, and the period d12 is shorter than the time required for executing the adjustment processing. Further, in FIG. 5A, the period d14 is a period during which the temperature of the fixing section 150 lowers from the TE-Print to the TE-Wait, and the period d14 is shorter than the time required for executing the adjustment processing. The d12 and the d14 are the temperature change period. In the example shown in FIG. 5A, the control section 1 determines that the temperature change period is shorter than the time required for executing the adjustment processing, and determines that the printer 130 should not carry out the adjustment processing while the temperature of the fixing section 150 is being changed.

FIG. 5B is a diagram illustrating a specific example of the temperature change of the fixing section 150 in a case in which the fixing section 150 fixes the non-decolorable toner on the sheet. The non-decolorable toner is toner of which the temperature at which the toner is fixed on the sheet is the TK-Print.

The vertical axis in FIG. 5B represents the temperature of the fixing section 150. The horizontal axis in FIG. 5B represents the time. The time advances in the sequence of t21, t22, t23, and t24 with t20 as the origin. A period between t20 and t21 is referred to as period d21. A period between t21 and t22 is referred to as period d22. A period between t22 and t23 is referred to as period d23. A period between t23 and t24 is referred to as period d24. A period after t24 is referred to as period d25.

The fixing section 150 is in the standby state during the period d21. The image forming control section 102 controls the fixing section 150 to maintain the temperature to the TK-Wait during the period d21. The fixing section 150 carries out the start of temperature rise at t21, and after the period d22, the temperature of the fixing section 150 becomes the temperature of the TK-Print at t22. The fixing section 150 fixes the non-decolorable toner onto the sheet by heating the non-decolorable toner at the temperature of the TK-Print during the period d23. The fixing section 150 carries out the start of temperature lowering at t23 when the heating of the non-decolorable toner is finished, and after the period d24, the temperature of the fixing section 150 becomes the temperature of the TK-Wait at t24. The temperature of the TK-Wait is the standby temperature of the fixing section 150 after the non-decolorable toner is fixed as shown in FIG. 3. The fixing section 150 is in the standby state during the period d25. The image forming control section 102 controls the fixing section 150 to maintain the temperature to the TK-Wait during the period d25.

In the example shown in FIG. 5B, the period d22 is a period during which the temperature of the fixing section 150 rises from the TK-Wait to the TK-Print, and the period d22 is shorter than the time required for executing the adjustment processing by the printer 130. Further, in the example shown in FIG. 5B, the period d24 is a period during which the temperature of the fixing section 150 lowers from the TK-Print to the TK-Wait, and the period d24 is shorter than the time required for executing the adjustment processing by the printer 130. The d22 and the d24 are the temperature change period. In the example shown in FIG. 5B, the control section 1 determines that the temperature change period is shorter than the time required for the execution of the adjustment processing, and determines that the printer 130 should not carry out the adjustment processing while the temperature of the fixing section 150 is being changed.

Figure 6:
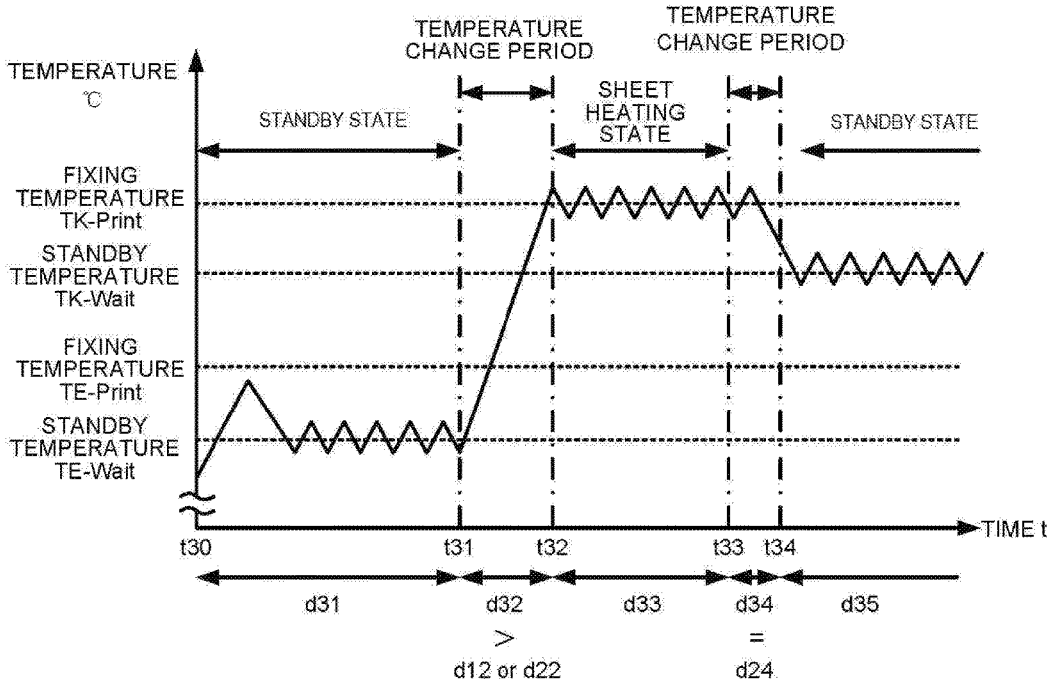
FIG. 6 is a diagram illustrating a specific example of the temperature change of the fixing section in a case in which a printer adjustment section carries out the adjustment processing during the temperature change period.

FIG. 6 is a diagram illustrating a specific example of the temperature change of the fixing section 150 in a case in which the printer 130 carries out the adjustment processing during the temperature change period.

The TE-Print, the TE-Wait, the TK-Print and the TK-Wait in FIG. 6 are the same as these in FIGS. 5A and 5B.

The vertical axis in FIG. 6 represents the temperature of the fixing section 150. The horizontal axis in FIG. 6 represents the time. The time advances in the sequence of t31, t32, t33, and t34 with t30 as the origin. A period between t30 and t31 is referred to as period d31. A period between t31 and t32 is referred to as period d32. A period between t32 and t33 is referred to as period d33. A period between t33 and t34 is referred to as period d34. A period after t34 is referred to as period d35.

The fixing section 150 is in the standby state during the period d31. The image forming control section 102 controls the fixing section 150 to maintain the temperature to the TE-Wait during the period d31. The fixing section 150 carries out the start of temperature rise at t31, and after the period d32, the temperature of the fixing section 150 becomes the temperature of the TK-Print at t32. The fixing section 150 fixes the non-decolorable toner onto the sheet by heating the non-decolorable toner at the temperature of the TK-Print during the period d33. The fixing section 150 carries out the start of temperature lowering at t33 when the heating of the non-decolorable toner is finished, and after the period d34, the temperature of the fixing section 150 becomes the temperature of the TK-Wait at t34. The temperature of the TK-Wait is the standby temperature of the fixing section 150 after the non-decolorable toner is fixed as shown in FIG. 3. The fixing section 150 is in the standby state during the period d35. The image forming control section 102 controls the fixing section 150 to maintain the temperature to the TK-Wait during the period d35.

In the example shown in FIG. 6, the period d32 is a period in which the temperature of the fixing section 150 rises from the TE-Wait to the TK-Print, and the period d32 is longer than the time required for executing the adjustment processing. Further, in the example shown in FIG. 6, the period d34 is a period in which the temperature of the fixing section 150 lowers from the TK-Print to the TK-Wait, and the period d34 is shorter than the time required for executing the adjustment processing. The d32 and the d34 are the temperature change period. Thus, the control section 1 determines that the temperature change period of the d32 is longer than the time required for the execution of the adjustment processing, and determines that the printer 130 carries out the adjustment processing while the temperature of the fixing section 150 is being changed.

Figure 7:
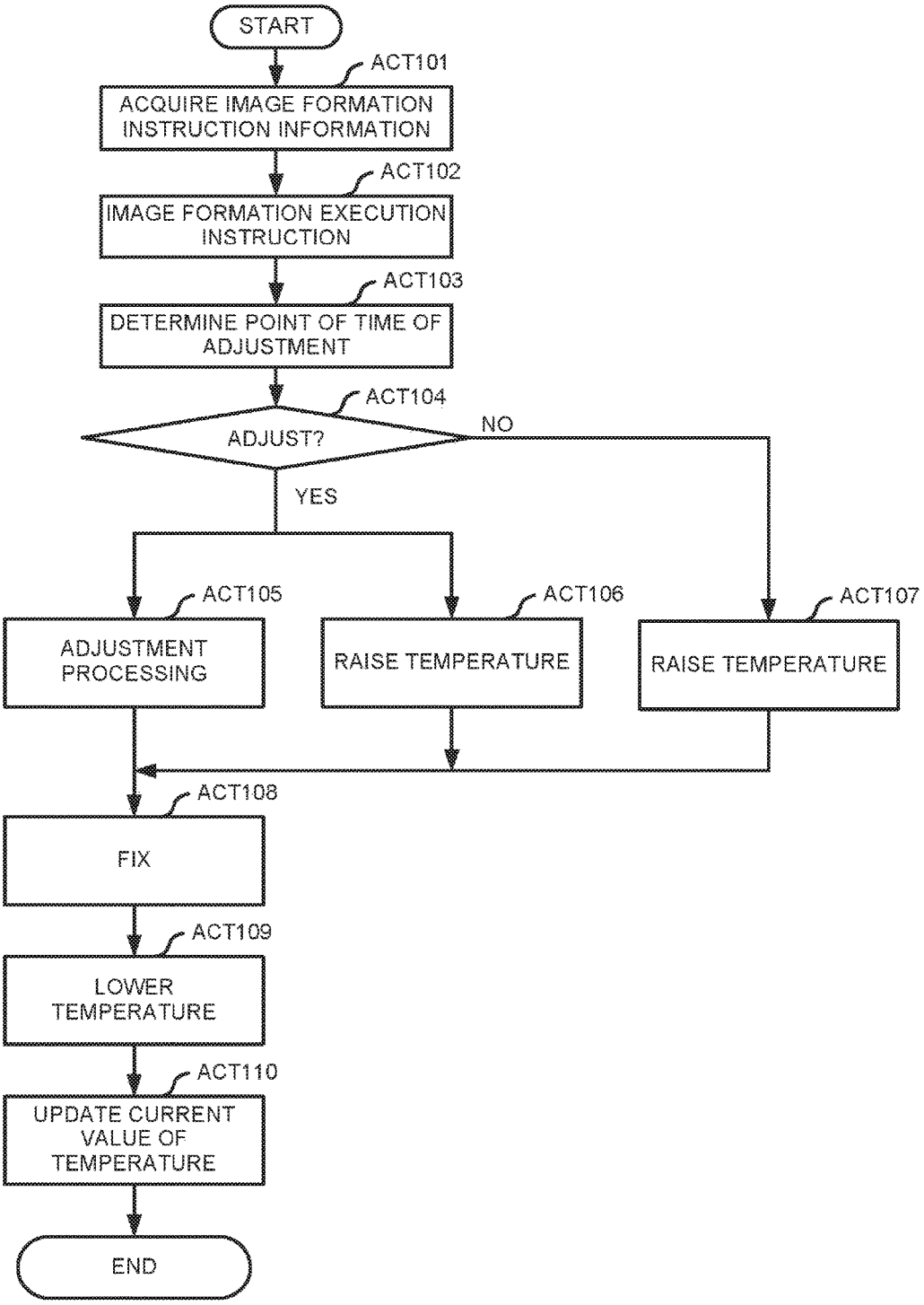
FIG. 7 is a flowchart illustrating a specific example of the flow of a processing in which the image forming apparatus according to the embodiment carries out a processing for fixing toner on a sheet and the adjustment processing.

FIG. 7 is a flowchart illustrating a specific example of the flow of a processing in which the image forming apparatus according to the embodiment carries out a processing for fixing the toner on the sheet and the adjustment processing.

The image formation instruction information is input through the control panel 120 (ACT 101). The image formation instruction information input to the control panel 120 is output to the image forming control section 102 and the determination section 101. The image forming control section 102 controls each functional section of the image forming apparatus 100 on the basis of the image formation instruction information input through the control panel 120 (ACT 102). For example, the image forming control section 102 generates the fixation instruction signal on the basis of the image formation instruction information, and controls the temperature of the fixing section 150 by outputting this signal to the fixing section 150. The determination section 101 determines whether or not the adjustment processing needs to be carried out by the printer 130 during the temperature change period on the basis of the acquired image formation instruction information. Firstly, the determination section 101 retrieves a record (hereinafter, referred to as a "usage record") indicating toner being used from the setting information table 901 stored in the auxiliary storage device 13, for example. The determination section 101 acquires a value of the fixing temperature from the retrieved usage record. The determination section 101 determines the timing of the adjustment processing on the basis of the temperature indicated by the value of the fixing temperature acquired and the temperature indicated by the temperature current value stored, for example, in the auxiliary storage device 13. For example, the determination section 101 determines that the adjustment processing is executed during the temperature change period in a case in which a temperature difference between the temperature indicated by the value of the fixing temperature of the usage record and the temperature indicated by the temperature current value is greater than or equal to a predetermined temperature. Hereinafter, the temperature difference between the temperature indicated by the value of the fixing temperature of the usage record and the temperature indicated by the temperature current value is referred to as a first value. Further, the predetermined temperature refers to, for example, a temperature at which the temperature of the fixing section 150 rises or lowers during the same time as the time when the adjustment processing is executed. A case in which the first value is greater than or equal to the predetermined temperature refers to, for example, the case of FIG. 6. In FIG. 6, a temperature difference between the TE-Wait and the TK-Print is the first value. In FIG. 6, the time when the temperature of the fixing section 150 rises by the temperature of the first value is longer than the time required for executing the adjustment processing. Thus, in the case of FIG. 6, the determination section 101 determines that the first value is greater than or equal to the predetermined temperature.

Furthermore, the first value may be an absolute value of a difference between the temperature indicated by the value of the fixing temperature of the usage record and the temperature indicated by the temperature current value stored in the auxiliary storage device 13, for example. The first value may be a ratio between the temperature indicated by the value of the set fixing temperature of the usage record and the temperature indicated by the temperature current value stored in the auxiliary storage device 13, for example. Further, hereinafter, the predetermined temperature is referred to as a second value. The second value is a value stored in the auxiliary storage device 13 in advance, for example.

In this way, the determination section 101 determines whether or not the adjustment processing is executed during the temperature change period (ACT 103).

Hereinafter, for the sake of description, a case in which the first value is the absolute value of the temperature difference between the temperature indicated by the value of the fixing temperature of the usage record and the temperature indicated by the temperature current value, and the second value is a positive value is assumed and described.

If the determination section 101 determines that the first value is greater than or equal to the second value (Yes in ACT 104), the determination section 101 controls the printer adjustment section 103 to execute the adjustment processing. The printer adjustment section 103 controls the printer 130 to execute the adjustment processing during the temperature change period of the fixing section 150 (ACT 105). While the adjustment processing is executed, the image forming control section 102 raises the temperature of the fixing section 150 (ACT 106) in parallel.

On the other hand, if the determination section 101 determines that the first value is smaller than the second value (No in ACT 104), while the image forming control section 102 raises the temperature of the fixing section 150, the adjustment processing is not carried out. In a case in which the first value is smaller than the second value, even if the adjustment processing is not carried out, the image forming control section 102 raises the temperature of the fixing section 150 to the temperature indicated by the value of the fixing temperature of the usage record (ACT 107).

If the temperature of the fixing section 150 reaches the temperature indicated by the value of the fixing temperature of the usage record, the image forming apparatus 100 causes the sheet on which the image is formed with the toner to pass through the fixing section 150. The fixing section 150 heats and presses the passing sheet, and fixes the toner onto the sheet (ACT 108). The sheet to be fixed by the fixing section 150 is conveyed from the sheet housing section 140 to the fixing section 150 via the printer 130 by a roller (not shown) included in the image forming apparatus.

After finishing the fixation, the image forming control section 102 lowers the temperature of the fixing section 150 from the temperature indicated by the value of the fixing temperature of the usage record to the temperature indicated by the value of the standby temperature of the usage record (ACT 109).

The image forming control section 102, which lowers the temperature of the fixing section 150, updates the temperature current value according to the temperature indicated by the value of the standby temperature of the usage record (ACT 110).

The image forming apparatus 100 according to the embodiment configured in this way includes the determination section 101, the image forming control section 102 and the printer adjustment section 103, and thus can carry out the adjustment processing of the printer 130 while the image forming control section 102 changes the temperature of the fixing section 150.

(Modification)

The toner used for the image forming by the image forming apparatus 100 according to the embodiment is not necessarily two types of toner consisting of the decolorable toner and the non-decolorable toner, and may be a plurality of decolorable toner having different fixing temperatures, or may be a plurality of non-decolorable toner having different fixing temperatures. Further, the toner used for the image forming by the image forming apparatus 100 according to the embodiment may be a plurality of special toner having respectively different temperatures. The special toner is, for example, toner having a color such as a golden color, a silver color, a fluorescent color, and a transparent color.

The image forming apparatus 100 according to the embodiment does not necessarily cause the fixing section 150 to return to the standby state after completing the fixation of the toner. In a case in which the image formation instruction information is input newly during an image forming period immediately after the image formation instruction information is input, the temperature of the fixing section 150 may be changed without passing the standby state. Hereinafter, the image formation instruction information input initially is referred to as first information, and the image formation instruction information input next is referred to as second information. The image forming period is a period from a point in time the image formation instruction information is input to a point in time the fixing section 150 carries out the start of temperature rise or the start of temperature lowering after passing the sheet heating state. Hereinafter, inputting the second information newly during the image forming period immediately after the first information is input to the image forming apparatus 100 is referred to as a continuous input. In a case in which the continuous input is made to the image forming apparatus 100, the fixing section 150 operates specifically as follows.

After the first information is input, the temperature of the fixing section 150 becomes a temperature (hereinafter, referred to as a "first temperature") at which the toner indicated by the first information is fixed. The fixing section 150 heats the toner indicated by the first information and fixes the toner onto the sheet, at the first temperature. The temperature of the fixing section 150 which finishes the fixation of the toner at the first temperature becomes a temperature (hereinafter, referred to as a "second temperature") at which the toner indicated by the second information is fixed. The fixing section 150 heats the toner indicated by the second information and fixes the toner onto the sheet, at the second temperature.

Furthermore, in a case in which the continuous input is made to the image forming apparatus 100, the determination section 101 may determine whether or not a correction processing is carried out during a transition on the basis of a difference between the first temperature and the second temperature. The transition is the change of the temperature of the fixing section 150 from the first temperature to the second temperature. In a case in which the time required for the transition is longer than the time required for carrying out the correction processing, the determination section 101 may determine that the correction processing is carried out during the transition.

The temperature represented by the standby temperature of the setting information according to the embodiment may not necessarily be a different value for each toner represented by the toner category information. More specifically, the temperature represented by the standby temperature of the setting information may be the same TK-Wait for the decolorable toner and the non-decolorable toner. Further, the temperature represented by the standby temperature of the setting information may be the same TE-Wait for the decolorable toner and the non-decolorable toner. The TK-Wait and the TE-Wait are the same as FIG. 6.

In this case, the determination section 101 may not necessarily determine the timing at which the adjustment processing is carried out on the basis of the standby temperature represented by the temperature current value and the temperature represented by the fixing temperature of the usage record. For example, the determination section 101 may determine the timing at which the adjustment processing is carried out on the basis of the value represented by the standby temperature of the usage record and the value represented by the fixing temperature.

Figure 8:
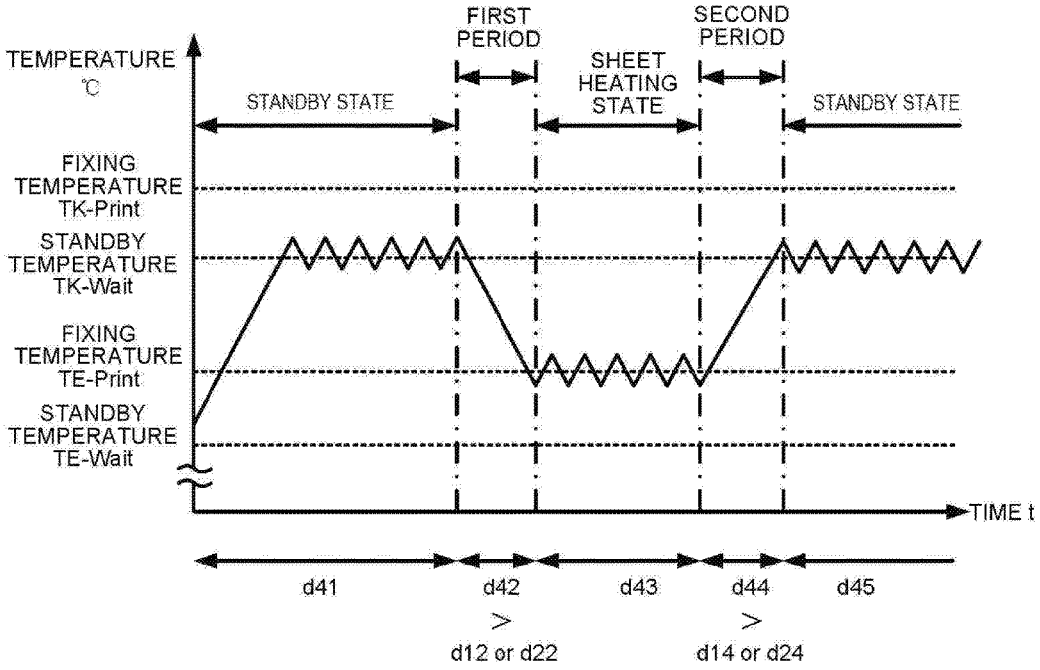
FIG. 8 is a diagram illustrating a specific example of the temperature change of the fixing section for carrying out fixation of decolorable toner in a case in which a standby temperature of the fixing section is the same for the decolorable toner and non-decolorable toner.

FIG. 8 is a diagram illustrating a specific example of the temperature change of the fixing section 150 which carries out the fixation of the decolorable toner in a case in which the standby temperatures of the fixing section 150 for the decolorable toner and the non-decolorable toner are the TK-Wait. In FIG. 8, the temperature of the fixing section 150 in the standby state prior to becoming the sheet heating state is the TK-Wait. The TE-Print, the TE-Wait, the TK-Print and the TK-Wait in FIG. 8 are the same as these in FIGS. 5A and 5B.

The decolorable toner is toner to be decolored at a temperature higher than the predetermined temperature. Hereinafter, the temperature at which the decolorable toner is decolored is referred to as a decoloring temperature. In a case in which the fixing section 150 fixes the decolorable toner onto the sheet, the temperature of the fixing section 150 should be a temperature lower than the decolorable temperature. Hereinafter, a period in which the temperature of the fixing section 150 is lowered from the TK-Wait to the TE-Print is referred to as a first period.

Thus, before the decolorable toner is fixed on the sheet, the temperature of the fixing section 150 serving as the TK-Wait is lowered from the TK-Wait to the TE-Print.

Further, the fixing section 150 which carries out the fixation of the decolorable toner at the temperature of the TE-Print transits to the standby state in which the temperature is raised to the TK-Wait and the temperature of the TK-Wait is maintained. Hereinafter, a period in which the temperature of the fixing section 150 is raised from the TE-Print to the TK-Wait is referred to as a second period.

Thus, the image forming apparatus 100 carries out the adjustment processing in one or both of the first period and the second period.

In this way, the temperature represented by the standby temperature of the setting information may be the same TK-Wait for the decolorable toner and the non-decolorable toner. Even in this case, it is possible that the image forming apparatus 100 carries out the adjustment processing during the change of the temperature of the fixing section 150.

A temperature relationship of the TE-Print, the TE-Wait, the TK-Print and the TK-Wait according to the embodiment is not necessarily the TK-Print, the TK-Wait, the TE-Print and the TE-Wait in descending order of temperature. The temperature relationship of the TE-Print, the TE-Wait, the TK-Print and the TK-Wait according to the embodiment may be the TK-Print, the TE-Print, the TK-Wait and the TE-Wait in descending order of temperature.

Figure 9A:
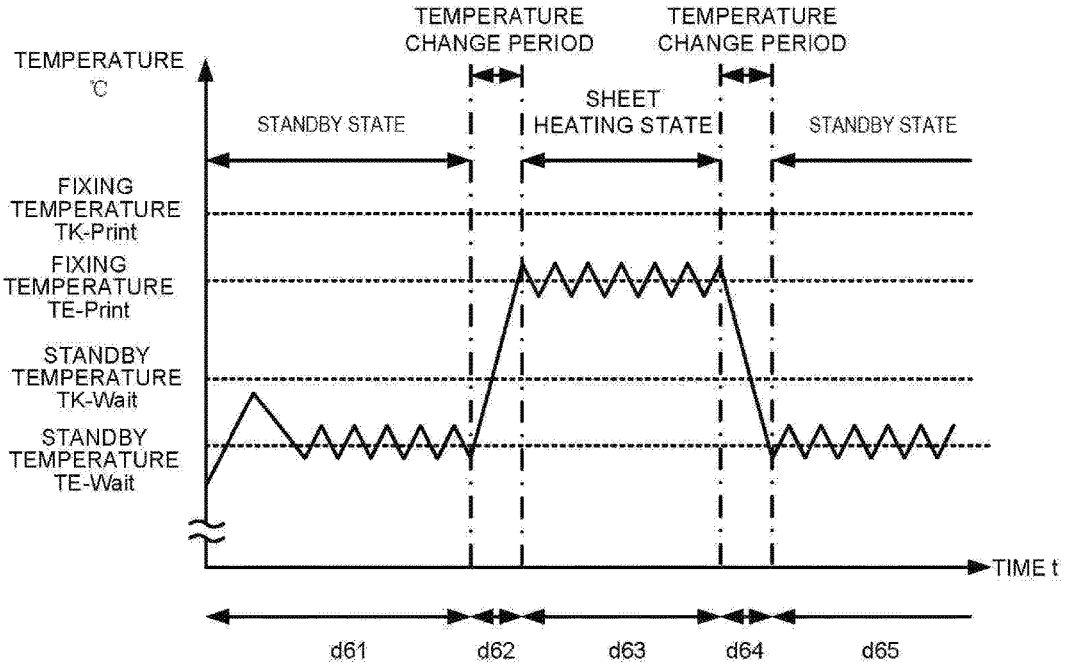
FIGS. 9A and 9B are each a diagram illustrating changes in the temperature of the fixing section during the sheet heating state.
Figure 9B:
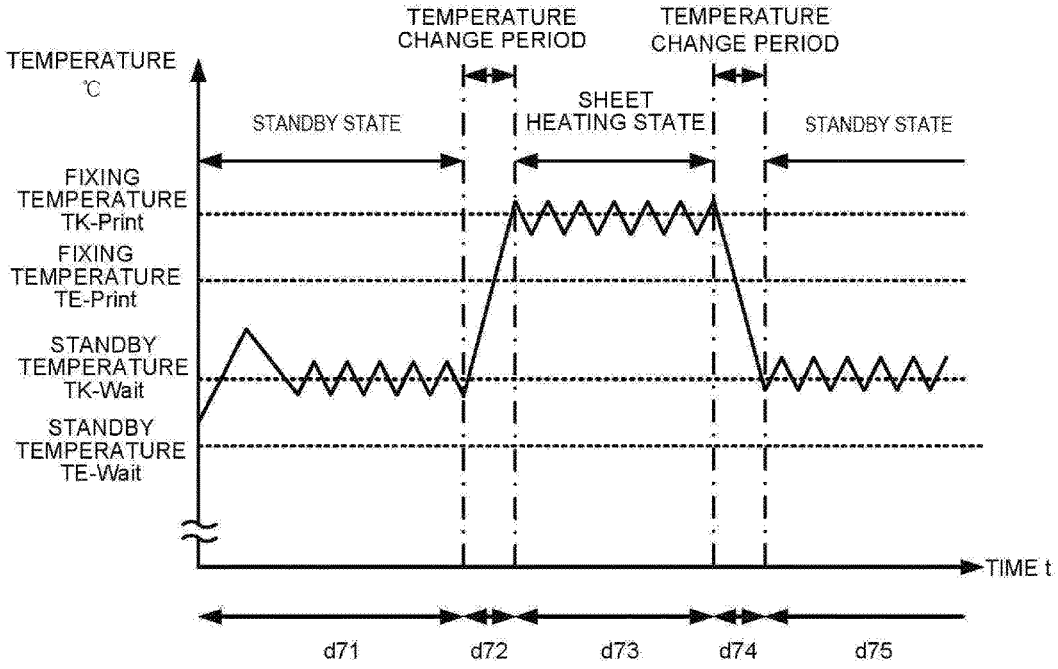

FIGS. 9A and 9B are each a diagram illustrating a specific example of the temperature change of the fixing section 150 in a case in which the decolorable toner is fixed on the sheet if the TE-Print is higher than the TK-Wait. FIG. 9A illustrates that the temperature of the fixing section 150 is raised from the TE-Wait to the TE-Print in the sheet heating state. FIG. 9B illustrates that the temperature of the fixing section 150 is raised from the TK-Wait to the TK-Print in the sheet heating state. In this way, the standby temperature of the fixing section 150 with respect to the decolorable toner may be higher than the fixing temperature of the fixing section 150 with respect to the decolorable toner.

Furthermore, the determination section 101 and the image forming control section 102 are not necessarily constituted as different functional sections, and may be constituted as one functional section.

Furthermore, the printer 130 is an example of the image forming section. Furthermore, the image forming control section 102 is an example of the control section. Furthermore, the printer adjustment section 103 is an example of the adjustment section. Furthermore, the determination section 101 is an example of the control section. The time when the image forming control section 102 outputs the fixation instruction signal to the fixing section 150 is an example of a predetermined point of time.

According to at least one embodiment described above, the image forming apparatus 100 can reduce the wait time of the user at the time of the image formation by including the determination section 101 which determines whether or not the change amount of the temperature of the fixing section 150 is larger than a predetermined change amount of the temperature and which controls the printer adjustment section 103 to carry out the adjustment processing while the temperature of the fixing section 150 is changed depending on this determination result.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:

an image forming section configured to form an image on a sheet;

a fixing section configured to heat the sheet having the image formed thereon to a fixing temperature; and a control section configured to determine a time period in which a temperature of the fixing section is changed between first and second temperatures, and to adjust parameters of the image forming section to reduce deterioration in image quality of the image formed by the image forming section so long as a length of the time period is greater than a predetermined length, wherein, the first temperature is a current temperature of the fixing section and the second temperature is a target temperature, and the control section is configured to control the fixing section to one of four temperatures including a standby temperature for decolorable toner, a fixing temperature for decolorable toner, a standby temperature for non-decolorable toner, and a fixing temperature for non-decolorable toner, and to determine that the length of the time period is greater than the predetermined length if the current temperature of the fixing section is the standby temperature for decolorable toner and the target temperature is the fixing temperature for non-decolorable toner.

2. The image forming apparatus according to claim 1, wherein the fixing temperature for fixing decolorable toner is less than the standby temperature for non-decolorable toner.

3. The image forming apparatus according to claim 1, wherein the fixing temperature for fixing decolorable toner is greater than the standby temperature for non-decolorable toner.

4. A method of determining when to perform adjustments to parameters of an image forming section of an image forming apparatus to reduce deterioration in image quality of the image formed by the image forming section, said method comprising:

determining a time period in which a temperature of a fixing section of the image forming apparatus is changed between a current temperature of the fixing section and a target temperature of the fixing section; and upon determining that a length of the time period is greater than a predetermined length, performing the adjustments to the parameters, wherein the fixing section is controlled to one of four temperatures including a standby temperature for decolorable toner, a fixing temperature for decolorable toner, a standby temperature for non-decolorable toner, and a fixing temperature for non-decolorable toner, and the length of the time period is determined to be greater than the predetermined length if the current temperature is the standby temperature for decolorable toner and the target temperature is the fixing temperature for non-decolorable toner.

5. The method according to claim 4, wherein the fixing temperature for fixing decolorable toner is greater than the standby temperature for non-decolorable toner.

6. The method according to claim 4, wherein the fixing temperature for fixing decolorable toner is greater than the standby temperature for non-decolorable toner.

* * * * *